US005998114A

United States Patent [19]

Bringley et al.

[11] Patent Number: 5,998,114

[45] Date of Patent: Dec. 7, 1999

[54] COLOR PHOTOGRAPHIC FILM EXHIBITING INCREASED RED SPEED AND SHARPNESS

[75] Inventors: Joseph F. Bringley; James A. Friday, both of Rochester, N.Y.

[73] Assignee: Eastman Kodak Company, Rochester, N.Y.

[21] Appl. No.: 09/292,147

[22] Filed: Apr. 15, 1999

[51] Int. Cl.[6] ..... G03C 1/035; G03C 1/46

[52] U.S. Cl. ..... 430/506; 430/509; 430/567

[58] Field of Search ..... 430/506, 567, 430/509

[56] References Cited

U.S. PATENT DOCUMENTS

| | | | |
|---|---|---|---|
| 4,388,401 | 6/1983 | Hasebe et al. | 430/505 |
| 4,640,890 | 2/1987 | Fujita et al. | 430/504 |
| 4,751,174 | 6/1988 | Toya | 430/502 |
| 5,275,929 | 1/1994 | Buitano et al. | 430/567 |
| 5,300,413 | 4/1994 | Sutton et al. | 430/503 |
| 5,302,499 | 4/1994 | Merrill et al. | 430/503 |
| 5,314,793 | 5/1994 | Chang et al. | 430/506 |

*Primary Examiner*—Mark F. Huff
*Attorney, Agent, or Firm*—Carl O. Thomas

[57] ABSTRACT

A color photographic element is disclosed comprised of a transparent film support and, coated on the support, a red recording layer unit containing the radiation-sensitive silver halide grains in a plurality of emulsion layers with each emulsion layer located to receive exposing radiation prior to an underlying emulsion layer containing silver halide grains of higher sensitivity than the silver halide grains located in the underlying emulsion layer. The red recording layer unit includes a red light reflective layer free of red absorbing dye and containing tabular silver halide grains having a thickness in the range of from 0.03 to 0.12 $\mu$m, an average aspect ratio of greater than 20, and a coating coverage of 0.5 to 1.25 g/m$^2$, and formed of greater than 50 mole percent bromide, based on silver, is located in the red recording layer unit interposed between two emulsion layers. Improvements in imaging speed and/or gamma with relatively low losses in image sharpness are realized.

11 Claims, No Drawings

COLOR PHOTOGRAPHIC FILM EXHIBITING INCREASED RED SPEED AND SHARPNESS

FIELD OF THE INVENTION

Color photographic elements are disclosed that exhibit increased red speed. Specifically, the invention relates to color photographic elements that employ radiation-sensitive silver halide emulsions in their red recording layer units.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{111} tabular" in referring to grains and emulsions indicates those in which the tabular grains have parallel major crystal faces lying in {111} crystal planes.

The term "high bromide" in referring to grains and emulsions indicates that bromide is present in a concentration greater than 50 mole percent, based on total silver.

In referring to silver halide grains and emulsions containing two or more halides, the halides are named in order of ascending concentrations.

The terms "blue", "green" and "red" indicate the portions of the visible spectrum lying, respectively, within the wavelength ranges of from 400 to 500 nm, 500 to 600 nm and 600 to 700 nm.

The term "minus blue" indicates the visible portion of the spectrum outside the blue portion of the spectrum—e.g., any spectral region in the range of from 500 to 700 nm.

The term "half peak absorption bandwidth" indicates the spectral region over which a dye exhibits an absorption equal to at least half its peak absorption.

The terms "front" and "back" indicate a position that is nearer or farther, respectively, than the support from the source of exposing radiation.

The terms "above" and "below" indicate a position nearer or farther, respectively, from the source of exposing radiation.

The term "subject" designates the person(s) and/or object (s) photographed.

The term "stop" in comparing photographic speeds indicates an exposure difference of 0.3 log E required to produce the same reference density, where E is exposure in lux-seconds.

The term "maximum gamma" is herein defined as the highest observed ratio of $\Delta D/\Delta E$, where $\Delta D$ is the increase in density that occurs in response to an increase in exposure $\Delta E$.

BACKGROUND OF THE INVENTION

Photographic images that allow recreation or approximation of the natural hues of a subject are conventionally captured on photographic film mounted in a camera. Camera speed films typically employ high bromide silver halide emulsions. Separate images of each of blue, green and red exposures are captured in blue, green and red recording layer units within the film. The blue recording layer unit contains chemically sensitized high bromide grains that may rely on native blue sensitivity or be sensitized to the blue region of the spectrum with one or more blue absorbing spectral sensitizing dyes. The green recording layer unit contains chemically sensitized high bromide grains that are sensitized to the green region of the spectrum with one or more green absorbing spectral sensitizing dyes. The red recording layer unit contains chemically sensitized high bromide grains that are sensitized to the red region of the spectrum with one or more red absorbing spectral sensitizing dyes. Dye-forming couplers are typically included in the layer units to allow dye images of distinguishable hue to be formed upon color processing. When the photographic film is intended for reversal processing to produce a viewable color positive image or when the photographic film is intended for use in exposing a color paper, the blue, green and red recording layer units contain couplers that form blue absorbing (yellow), green absorbing (magenta), and red absorbing (cyan) image dyes, respectively. When the dye image information is intended to be retrieved from the photographic film by digital scanning, the dye images can be of any hue, provided they are distinguishable. The layer units in a camera speed film are coated so that exposing radiation is first received by a blue recording layer unit, then a green recording layer unit, and finally a red recording layer unit. When two or more layer units differing in speed are provided for recording in a single spectral region, the exposing radiation receiving coating sequence of the slower, but not the faster recording layer units, is sometimes varied.

The high bromide silver halide grains incorporated in the green and red (minus blue) recording layer units of camera speed films have significant blue sensitivity. Coating the blue recording layer unit over the minus blue recording layer units protects the latter from blue light contamination.

The components used to construct color photographic films are disclosed in *Research Disclosure,* Vol. 389, September 1996, Item 38957. *Research Disclosure* is published by Kenneth Mason Publications, Ltd., Dudley House, 12 North St., Emsworth, Hampshire P010 7DQ, England. The following topics of Item 38957 are particularly pertinent to the present invention:

I. Emulsion grains and their preparation (most particularly the last sentence of paragraph (1) of B. Grain morphology);

II. Vehicles, vehicle extenders, vehicle-like addenda and vehicle related addenda;

IV. Chemical sensitization;

V. Spectral sensitization and desensitization
A. Sensitizing dyes;

X. Dye image formers and modifiers (except A. silver dye bleach);

XI. Layers and layer arrangements;

XII. Features applicable only to color negative;

XIII. Features applicable only to color positive (except C. Color positives derived from color negatives);

XV. Supports.

Sutton et al U.S. Pat. No. 5,300,413 discloses high bromide {111} tabular grain emulsions with grain dispersities and thicknesses controlled to facilitate red light reflection.

PROBLEM TO BE SOLVED

The human eye obtains about 60 percent of its visual information from the green region of the spectrum. About 30 percent of visual information comes from the red region of the spectrum, and only about 10 percent of visual information comes from the blue region of the spectrum.

The red recording layer unit, being coated beneath the blue and green recording layer units, is placed in the optically least favored position in the photographic film. In this least favored position the speed and sharpness of the red recording layer unit are degraded by any red light absorption and scattering that occurs in the overlying layer units.

The speed of the red recording layer unit can be increased by increasing the sensitivity of the silver halide grains in this layer unit. A common technique for accomplishing this is to increase the mean ECD of the grains. Unfortunately, it is well recognized in the art that each stop increase in speed arrived at by increasing grain size can be expected to increase image granularity by 7 grain units.

SUMMARY OF THE INVENTION

In one aspect this invention is directed to a color photographic element comprised of a transparent film support and, coated on the support, blue, green and red recording layer units containing couplers that form first, second and third image dyes, respectively, each of the layer units being comprised of radiation-sensitive silver halide grains containing greater than 50 mole percent bromide, based on silver, for forming a developable latent image upon imagewise exposure, each of the first, second and third image dyes exhibiting a half-peak absorption bandwidth that occupies at least one 25 nm spectral region not occupied by the remaining of the first, second and third image dyes, and at least the red recording layer unit containing the radiation-sensitive silver halide grains in a plurality of emulsion layers with each emulsion layer located to receive exposing radiation prior to an underlying emulsion layer containing silver halide grains of higher sensitivity than the silver halide grains located in the underlying emulsion layer, wherein, a red light reflective layer free of red absorbing dye and containing tabular silver halide grains having a thickness in the range of from 0.03 to 0.12 $\mu$m, an average aspect ratio of greater than 20, and a coating coverage of 0.5 to 1.25 g/m$^2$, and formed of greater than 50 mole percent bromide, based on silver, is located in the red recording layer unit interposed between two of the emulsion layers.

It has been discovered that the addition of the red light reflective layer constructed as described to the red recording layer unit is capable of increasing the speed and/or gamma of the red recording layer unit. Further, the enhancement of these photographic properties is realized with limited image degradation in the red recording layer unit.

DETAILED DESCRIPTION OF THE INVENTION

A simple construction of a color photographic element satisfying the requirements of the invention is illustrated by the following:

| |
|---|
| Protective Overcoat |
| Blue Recording Layer Unit |
| Green Recording Layer Unit |
| Red Recording Layer Unit |
| Antihalation Layer Unit |
| Transparent Film Support |
| (I) |

Each of the blue, green and red recording layer units incorporate high bromide silver halide grains for latent image formation upon imagewise exposure. The high bromide grains preferably each contain greater than 70 mole percent bromide and optimally greater than 90 mole percent bromide, based on total silver. The grains can form latent image sites at the surface of the grains, internally or at both locations, but preferably form latent image sites primarily at the surface of the grains. The portion of the silver halide not accounted for by silver bromide can be any convenient conventional concentration of silver iodide and/or chloride. Silver iodide can be present up to its solubility limit in silver bromide, typically cited as 40 mole percent, based on total silver. However, iodide concentrations of less than 20 mole percent are preferred and iodide concentrations of less than 10 mole percent, based on total silver, are most preferred. Silver chloride concentrations are preferably limited to less than 30 mole percent and optimally less than 10 mole percent, based on total silver. Silver iodobromide grain compositions are specifically preferred. Other contemplated grain compositions include silver bromide, silver chlorobromide, silver iodochlorobromide and silver chloroiodobromide. The latent image forming silver halide gains can take the form of those disclosed in Research Disclosure, Item 38957, cited above, I. Emulsion grains and their preparation.

In a specifically preferred form the latent image forming silver halide grains in at least the minus blue (i.e, green and red) recording layer units are provided by chemically and spectrally sensitized {111} tabular grain emulsions. Similar latent image forming silver halide grains can be employed in the blue recording layer unit, although non-tabular grain emulsions are often used in the blue recording layer unit for latent image formation in combination with minus blue layer units that incorporate tabular gain latent image forming emulsions. Specific illustrations of high bromide tabular grain emulsions are provided by the following patents, here incorporated by reference:

List T

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;

Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927;
Daubendiek et al U.S. Pat. No. 5,576,168;
Olm et al U.S. Pat. No. 5,576,171;
Deaton et al U.S. Pat. No. 5,582,965;
Maskasky U.S. Pat. No. 5,604,085;
Reed et al U.S. Pat. No. 5,604,086;
Eshelman et al U.S. Pat. No. 5,612,175;
Levy et al U.S. Pat. No. 5,612,177;
Wilson et al U.S. Pat. No. 5,614,358;
Eshelman et al U.S. Pat. No. 5,614,359;
Maskasky U.S. Pat. No. 5,620,840;
Wen et al U.S. Pat. No. 5,641,618;
Irving et al U.S. Pat. No. 5,667,954;
Maskasky U.S. Pat. No. 5,667,955;
Maskasky U.S. Pat. No. 5,691,131;
Maskasky U.S. Pat. No. 5,693,459;
Black et al U.S. Pat. No. 5,709,988;
Jagannathan et al U.S. Pat. No. 5,723,278;
Deaton et al U.S. Pat. No. 5,726,007;
Irving et al U.S. Pat. No. 5,728,515;
Bryant et al U.S. Pat. No. 5,728,517;
Maskasky U.S. Pat. No. 5,733,718;
Jagannathan et al U.S. Pat. No. 5,736,312;
Antoniades et al U.S. Pat. No. 5,750,326;
Brust et al U.S. Pat. No. 5,763,151; and
Maskasky et al U.S. Pat. No. 5,792,602.

Typically the {111} tabular grain emulsions are those in which the { 111} tabular grains account for greater than 50 percent, preferably 70 percent and optimally 90 percent, of total grain projected area. High bromide emulsions in which {111} tabular grains account for substantially all (>97%) of total grain projected area are disclosed in the patents of List T cited above and are specifically contemplated. The {111} tabular grains preferably have an average thickness of less than 0.3 $\mu$m and most preferably less than 0.2 $\mu$m. It is specifically contemplated to employ ultrathin tabular grain emulsions in which the tabular grains having a thickness of less than 0.07 $\mu$m account for greater than 50 percent of total grain projected area.

When tabular grain emulsions are relied upon for latent image formation in the blue recording layer unit, they can have the thickness characteristics noted above. However, to obtain speed by absorption of blue light within the grains, it is recognized that the tabular grains having a thickness of up to 0.50 $\mu$m can account for at least 50 percent of total grain projected area in the blue recording layer units.

The high bromide {111} tabular grains preferably have an average aspect ratio of at least 5, most preferably greater than 8. Average aspect ratios can range up to 100 or higher, but are typically in the range of from 12 to 60. The average ECD of the latent image forming emulsions is typically less than 10 $\mu$m, with mean ECD's of less than 6 $\mu$m being particularly preferred to maintain low levels of granularity.

The latent image forming high bromide emulsions are chemically sensitized. Any of the chemical sensitizations of *Research Disclosure,* Item 38957, IV. Chemical sensitization, cited above as well as the patents, incorporated by reference, of List T, above, can be employed. One or a combination of sulfur, selenium and gold sensitizations are commonly employed. Additionally, the epitaxial sensitization of the grains is contemplated.

In all instances the latent image forming grains in the minus blue recording layer units are spectrally sensitized. The green recording layer unit contains one or a combination of green absorbing spectral sensitizing dyes adsorbed to the surfaces of the latent image forming grains. The red recording layer unit contains one or a combination of red absorbing spectral sensitizing dyes adsorbed to the surfaces of the latent image forming grains. The latent image forming grains of the blue recording layer unit can rely entirely on native blue absorption, particularly when the grains contain iodide. Preferably the blue recording layer unit contains one or a combination of blue absorbing spectral sensitizing dyes adsorbed to the surfaces of the latent image forming grains. Spectral sensitizing dyes and dye combinations can take the forms disclosed in *Research Disclosure,* Item 38957, V. Spectral sensitization and desensitization, A. sensitizing dyes, and in the patents, here incorporated by reference of List T.

In addition to silver halide grains the dye image forming layer units contain dye image-forming couplers to produce image dyes following imagewise exposure and color processing. When the photographic elements are intended to be used for exposing a color paper or to form viewable reversal color images, the blue, green and red recording layer units contain dye-forming couplers that form on coupling yellow, magenta and cyan image dyes, respectively. When the photographic elements are intended to be scanned, an image dye of any convenient hue can be formed in any of the blue, green and red recording layer units, provided that the image dyes can be differentiated by inspection or scanning. To facilitate scanning each image dye is contemplated to exhibit a half peak absorption bandwidth of at least 25 nm, preferably 50 nm, that does not overlap the half peak absorption bandwidth of any image dye in another recording layer unit. Dye image-forming couplers can take any of the various forms disclosed in *Research Disclosure,* Item 38957, X. Dye image formers and modifiers, B. Image-dye-forming couplers.

The red recording layer unit is made up of at least two latent image forming emulsion layers of differing speeds. Common coating arrangements include "double coated" red recording layer units containing a fast and a slow emulsion layer and "triple coated" red recording layer units containing fast, intermediate (a.k.a., mid) and slow speed emulsion layers. Typically in double coated arrangements the minimum speed difference between two emulsion layers is at least one stop (0.3 log E) and often range up to three stops (0.9 log E). In triple coated arrangements slow to mid and mid to fast speed differences are in these ranges.

In addition to the emulsion layers, the red recording layer unit contains a red reflective layer. Typical arrangements include the following:

| |
|---|
| Fast Latent Image Forming Layer |
| Reflective Layer |
| Slow Latent Image Forming Layer |
| (II) |
| Fast Latent Image Forming Layer |
| Mid Latent Image Forming Layer |
| Reflective Layer |
| Slow Latent Image Forming Layer |
| (III) |
| Fast Latent Image Forming Layer |
| Reflective Layer |
| Mid Latent Image Forming Layer |
| Slow Latent Image Forming Layer |
| (IV) |

The reflective layer contains high bromide tabular grains. To perform a red light reflecting function the high bromide tabular grains can take any of the silver halide compositions described above for the image recording layer units. Additionally, the silver halide grains in the reflective layer are free of any red absorbing dye, notably any red absorbing spectral sensitizing dye.

To facilitate red light reflection, the red light reflective layer contains tabular silver halide grains having a selected thickness range of from 0.03 to 0.12 $\mu$m, preferably 0.03 to 0.07 $\mu$m. Throughout this thickness range the tabular grains reflect red light efficiently and, depending upon the exact thickness chosen, have the capability of reflecting blue and/or green light. However, blue and/or green light reflection is reduced by light of these wavelengths being absorbed in the overlying blue recording layer unit, blue filter layer (commonly employed), and the green recording layer unit. Image sharpness in the blue and green recording layer units is benefited by the specular nature of light reflection from the reflective layer. Although it would seem advantageous to select the tabular grains to maximize red light reflection as opposed to blue and/or green light reflection, the fact is that the less efficient red light reflection per grain exhibit by the tabular grains toward the lower end of the thickness range is at any given coating coverage level compensated for by the larger number of thinner tabular grains. For example, at a fixed silver coating coverage, four tabular grains having a thickness of 0.03 $\mu$m can be substituted for each tabular grain having a thickness of 0.12 $\mu$m. While each of the 0.03 $\mu$m tabular grains does not reflect red light as efficiently as one 0.12 $\mu$m tabular grain, the four to one ratio at a fixed coating coverage compensates for differences in efficiencies. Reflective tabular grain coating coverages in the range of from 0.5 to 1.25 g/m$^2$, based on silver, are contemplated.

The tabular grains in the selected thickness range are further chosen to exhibit an average aspect ratio of greater than 20, preferably greater than 30, and most preferably greater than 40. Thus, the average ECD of these grains is in all instances greater than 0.6 $\mu$m. It is generally taught that latent image forming tabular grains should have an average ECD of no higher than 10 $\mu$m, since granularity is unacceptably high above this level for most, if not all, imaging applications. This restriction on maximum average ECD has no applicability to any of the silver halide grains in the reflective layer when none of these grains cause a dye image to be formed and hence have no impact on image granularity in the recording layer units. Thus, the maximum ECD of the tabular grains of selected thickness can range up the limits of convenience for emulsion preparation. For example, average ECD's of up to 15 or even 20 $\mu$m are contemplated. As the average ECD of the grains increases, the proportion of the grains accounted for by the edges (e.g., the proportion of the grain volume that lies within 0.1 $\mu$m of an edge) is reduced, and the specularity of light transmission and reflection is enhanced. This contributes to increasing image sharpness in the red blue recording layer unit.

It is possible to employ in the reflective layer high bromide tabular grains in the selected thickness range that are present with silver halide grains that are non-tabular or are tabular but exhibit thicknesses outside the selected thickness range. For example, it is possible to incorporate in the reflective layer a high bromide silver halide emulsion in which the tabular grains in the selected thickness range are precipitated along with other grains. The presence of grains outside the selected thickness range increase total silver coverages and reduce the overall efficiency of the reflective layer. It is therefore preferred to minimize the presence of grains outside the selected thickness range. Preferably the tabular grains in the selected thickness range account for greater than 70 percent of total grain projected area and most preferably greater than 90 percent of total grain projected area in the reflective layer. Since tabular grain emulsions can be readily precipitated with very little variance in tabular grain thickness, it is possible to precipitate tabular grain emulsions in which tabular grains within the selected thickness range account for greater than 99 percent of total grain projected area.

The patent teachings of List T are enabling for the preparation of high bromide tabular grain emulsions for use in the reflective layer, with the following patents particularly teaching high proportions of tabular grains: Saitou et al U.S. Pat. No. 4,797,354; Tsaur et al U.S. Pat. Nos. 5,147,771, '772, '773, 5,171,659, 5,210,013, and Antoniades et al U.S. Pat. No. 5,250,403. Sutton et al U.S. Pat. No. 5,334,469 is an improvement on the teachings of Tsaur et al that further demonstrates selections of tabular grain thicknesses within the selected range.

The silver halide grains in the red light reflective layer are free of adsorbed dye absorbs red light, since this would interfere with red light reflection. Thus, the grains in the reflective layer are free of adsorbed red absorbing spectral sensitizing dye. This precludes the red light reflective layer from participating in latent image formation within the red recording layer unit. The grains in the reflective layer can be chemically sensitized or free of intentional chemical sensitization, since, in the absence of spectral sensitization, the grains in either form do not participate in latent image formation. For the same reason it is also possible to locate image dye forming compound in the reflective layer, but preferably no image dye forming compound is present.

When two or more silver halide emulsion layers relied upon for latent image formation and of differing speed are incorporated within a single dye image recording layer unit, they are generally chose to differ in speed by at least 0.3 log E. Speed differences of up to 0.9 log E are contemplated.

The remaining features of the color photographic element (I) can take any convenient conventional form. In addition to the silver halide grains and image dye-forming coupler, the blue, green and red recording layer units as well as all other processing solution permeable layers of the color photographic elements, such as the protective overcoat and the antihalation layer unit shown in element (I), contain processing solution permeable vehicle, typically hydrophilic colloid, such as gelatin or a gelatin derivative, as well as vehicle extenders and hardener, examples of which are listed in Research Disclosure, Item 38957, II. Vehicles, vehicle extenders, vehicle-like addenda and vehicle related addenda.

The layers containing latent image forming silver halide grains additionally usually contain antifoggants and/or stabilizers, such as those listed *Research Disclosure,* Item 38957, VII. Antifoggants and stabilizers. The dye image forming layers can contain in addition to the dye image-forming couplers other dye image enhancing addenda, such as image dye modifiers, hue modifiers and/or stabilizers, and solvents for dispersing couplers and related hydrophobic addenda, summarized in X. Dye image formers and modifiers, sections C, D and E. Colored dye-forming couplers, such as masking couplers, are commonly incorporated in negative-working photographic films, as illustrated in *Research Disclosure,* Item 38957, XII. Features applicable only to color negative.

The antihalation layer unit shown in element (I) is not essential, but is highly preferred to improve image sharpness. The antihalation layer unit can be coated between the red recording layer unit and the transparent film support or, alternatively, coated on the back side of the transparent film support. In addition to vehicle to facilitate coating the antihalation layer unit contains light absorbing materials, typically dyes, chosen to be decolorized (discharged) on processing, a summary of which is provided in *Research Disclosure,* Item 38957, VIII. Absorbing and scattering materials, B. Absorbing materials and C. Discharge.

The protective overcoat is not essential, but is highly preferred to provide physical protection to the blue recording layer unit. In its simplest form the protective overcoat can consist of a single layer containing a hydrophilic vehicle of the type described above. The protective overcoat is a convenient location for including coating aids, plasticizers and lubricants, antistats and matting agents, a summary of which is provided in *Research Disclosure,* Item 38957, IX. Coating and physical property modifying addenda. Additionally, ultraviolet absorbers are often located in the protective overcoat, illustrated in *Research Disclosure,* Item 38957, UV dyes/optical brighteners/luminescent dyes. Often the protective overcoat is divided into two layers with the above addenda being distributed between these layers. It is also common practice to place a layer similar to the protective overcoat in the back side of the support containing surface property modifying addenda. When an antihalation layer is coated on the back side of the support, surface modifying addenda are usually incorporated in this layer.

To avoid color contamination of the blue, green and red recording layer units, it is conventional practice to incorporate a oxidized developing agent scavenger (a.k.a. antistain agent) in the layer units to prevent migration of oxidized color developing agent from one layer unit to the next adjacent layer unit. Preferably the oxidized color developing agent is located in a separate layer, not shown in (I) above, at the interface of the layer units. Antistain agents are summarized in *Research Disclosure,* Item 38957, D. Hue modifiers/stabilization, paragraph (2).

It is also preferred to locate a blue filter material, such as a processing solution decolorizable yellow dye or Carey Lea silver, in a layer between the latent image forming grains in the blue recording layer unit and the next adjacent layer unit. These filter materials are also disclosed in *Research Disclosure,* Item 38957, VIII. Absorbing and scattering materials, B. Absorbing materials and C. Discharge.

The transparent film support can take any convenient conventional form. The film support is generally understood to include subbing layers placed on the film to improve the adhesion of hydrophilic colloid layers. Conventional transparent film support characteristics are summarized in *Research Disclosure,* Item 38957, XV. Supports (2), (3), (4), (7), (8) and (9).

When the color photographic films are intended to be scanned, either for image retrieval or for retrieving information incorporated during manufacture for aiding exposure or processing, they can contain features such as those illustrated by *Research Disclosure,* Item 38957, XIV. Scan facilitating features. When a magnetic recording layer is incorporated in the color film, it is preferably located on the back side of the film support.

The color films of invention are specifically contemplated for use in cameras used to capture visible light images of photographic subjects. Exposures can range from high intensity, short duration exposures to low intensity, long duration exposures. Since the present invention offers the capability of increasing red speeds, shorter exposures at lower lighting intensities are specifically contemplated. For example, the present invention is particularly suited for producing color films having ISO ratings higher than 200, preferably higher than 400 and optimally higher than 1000. The color films can be employed in cameras intended for repeated use or only limited use (e.g., single-use) cameras. Contemplated features of limited use cameras are disclosed in *Research Disclosure,* Item 38957, XVI. Exposure, (2).

Once imagewise exposed, the color photographic films of the invention can be processed in any convenient conventional manner to produce dye images that correspond to the latent images in the recording layer units or that are reversals of the latent images. Most commonly, negative-working emulsions are incorporated in the recording layer units which produce a color negative dye image when subjected to a single color development step. If direct-positive emulsions are substituted in the recording layer units, a single color development step produces a positive dye image—i.e., a reproduction of the subject photographed. When negative-working emulsions are incorporated in the recording layer units, reversal processing (black-and-white development followed by color development), is capable of producing a positive dye image. Illustrations of conventional color processing systems are provided by *Research Disclosure,* Item 38957, XVIII. Chemical development systems, B. Color-specific processing systems.

A specifically preferred processing system is the Kodak Flexicolor ™ C-41 color negative process. It is specifically contemplated to introduce modifications to the color film and the process to permit development times of less than 2 minutes with improved results, as illustrated by Becher et al U.S. Ser. No. 09/014,842, filed Jan. 28, 1998; U.S. Ser. No. 09/015,720, filed Jan. 29, 1998; and U.S. Ser. No. 09/024,335, filed Feb. 17, 1998; each commonly assigned and currently allowed, here incorporated by reference.

EXAMPLES

The invention can be better appreciated by reference to the following specific embodiments. Component coating coverages, in parenthesis, are reported in units g/m$^2$. Silver halide coating coverages are based on the weight of silver. The suffix E identifies elements as satisfying the requirements of the invention while suffix C identifies comparative elements.

CC-1
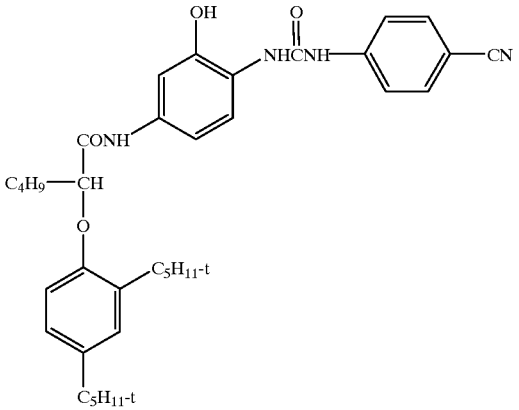
CC-2
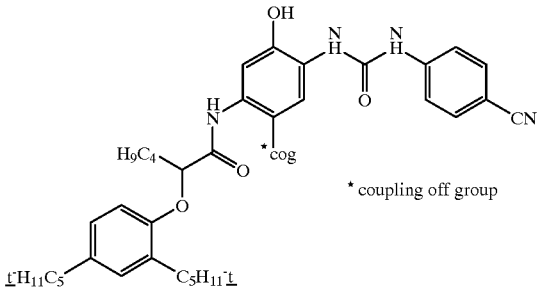
CM-1
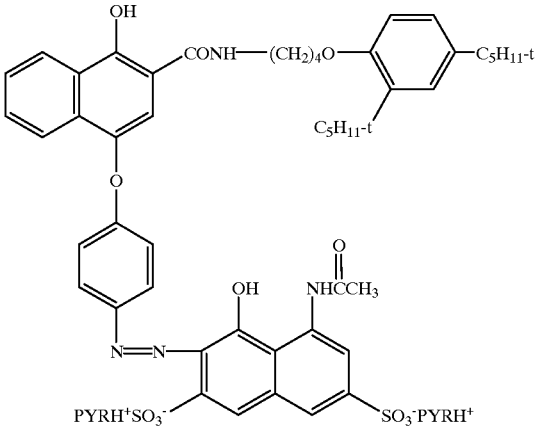
IR-1
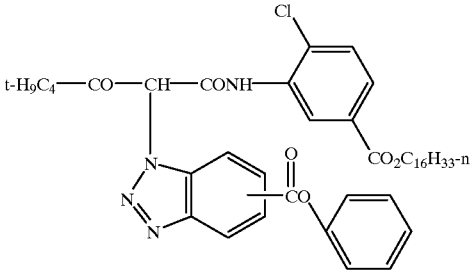
-continued
IR-3
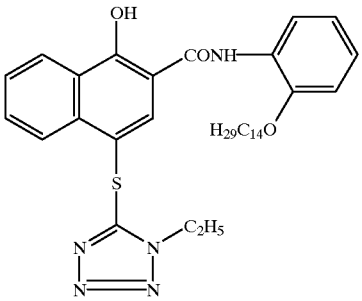
IR-4
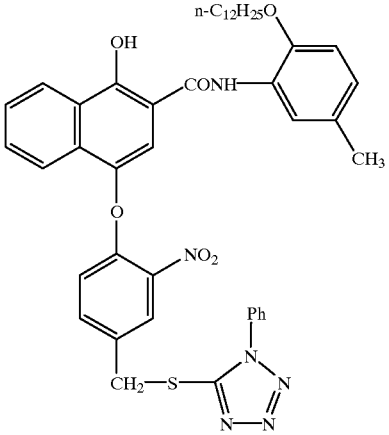
OxDS-1
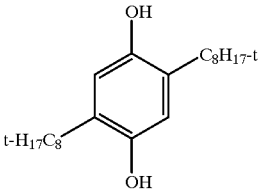
UV-2
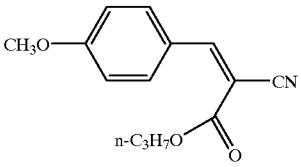
UV-1
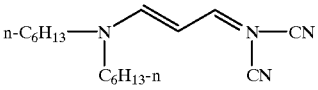
RSD-1
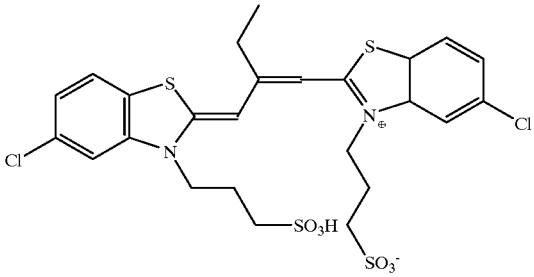

-continued

RSD-2

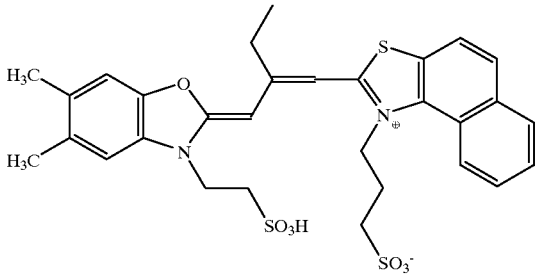

B-1

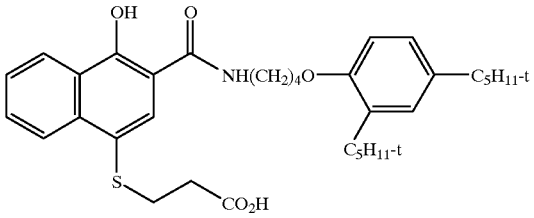

Color Elements

Two series of color photographic elements were constructed. In Series I the elements differed only in Layer 3. In comparison element 1C Layer 3 was omitted. In Series II the elements differed only Layer 4. In comparison element 10C Layer 4 was omitted. In the remaining elements Layer 3 of Series I and Layer 4 of Series II contained gelatin (1.077) and OxDS-1(0.0154), with the grain size choices and coating coverages reported below in Table I. The grains in Layer 3 were in each instance silver bromide tabular grains with tabular grains of the indicated thickness accounting for 99.9 percent of total grain projected area. The elements were hardened with bis(vinylsulfonyl)methane hardener (0.27) uniformly distributed through all of the gelatin containing layers. The antifoggant 4-hydroxy-6-methyl-1,3,3a,7-tetraazaindene was employed, and the elements contained other conventional addenda that remained unchanged from element to element and that did not participate in dye image formation, such as surfactants, high boiling solvents, coating aids, sequestrants, lubricants, matte beads and tinting dyes.

Element Series I

Layer 1 (Protective Overcoat Layer): gelatin at (1.077).

Layer 2 (Fast Cyan layer): a red sensitized (with a mixture of RSD-1 and RSD-2) silver iodobromide tabular grain emulsion: 4.0 μm ECD×0.13 μm t, 4.0 mole % I, based on Ag, at (0.130), cyan dye-forming coupler CC-2 at (0.205), IR-4 (0.025), IR-3 (0.022)-2 at (0.022), OxDS-1 (0.014) and gelatin at (1.45).

Layer 3

Layer 4 (Mid cyan layer): a red sensitized (with a mixture of RSD-1 and RSD-2) silver iodobromide tabular grain emulsion: 2.2 μm ECD×0. 12 μm t, 3.0 mole % I, based on Ag, at (1.17), cyan dye-forming coupler CC-2 at (0.181), IR-4 (0.011), masking coupler CM-1 at (0.032), OxDS-1 (0.011) and gelatin at (1.61).

Layer 5 (Slow cyan layer): a blend of two red sensitized (all with a mixture of RSD-1 and RSD-2) silver iodobromide tabular grain emulsions: (i) 1.2 μm ECD×0.12 μm t, 4.1 mole % I, based on Ag, at (0.265) and (ii) 1.0 μm ECD×0.08 μm t, 4.1 mole % I, based on Ag, at (0.312), cyan dye-forming coupler CC-1 at (0.227), masking coupler CM-1 at (0.032), bleach accelerator releasing coupler B-1 at (0.080), and gelatin at (1.67).

Layer 6 (Antihalation layer): black colloidal silver at (0.151), UV-1 and UV-2, both at (0.075) and gelatin at (2.15).

Support: Cellulose triacetate.

Element Series II

Layer 1 (Protective Overcoat Layer): gelatin at (1.077).

Layer 2 (Fast Cyan layer): a red sensitized (with a mixture of RSD-1 and RSD-2) silver iodobromide tabular grain emulsion: 4.0 μm ECD×0.13 μm t, 4.0 mole % I, based on Ag, at (0.130), cyan dye-forming coupler CC-2 at (0.205), IR-4 (0.025), IR-3 (0.022)-2 at (0.022), OxDS-1 (0.014) and gelatin at (1.45).

Layer 3 (Mid cyan layer): a red sensitized (with a mixture of RSD-1 and RSD-2) silver iodobromide tabular grain emulsion: 2.2 μm ECD×0.12 μm t, 3.0 mole % I, based on Ag, at (1.17), cyan dye-forming coupler CC-2 at (0.181), IR-4 (0.011), masking coupler CM-1 at (0.032), OXDS-1 (0.011) and gelatin at (1.61).

Layer 4 (Slow cyan layer): a blend of two red sensitized (all with a mixture of RSD-1 and RSD-2) silver iodobromide tabular grain emulsions: (i) 1.2 μm ECD×0.12 μm t, 4.1 mole % I, based on Ag, at (0.265) and (ii) 1.0 μm ECD×0.08 μm t, 4.1 mole % I, based on Ag, at (0.312), cyan dye-forming coupler CC-1 at (0.227), masking coupler CM-1 at (0.032), bleach accelerator releasing coupler B-1 at (0.080), and gelatin at (1.67).

Layer 5 (Antihalation layer): black colloidal silver at (0.151), UV-1 and UV-2, both at (0.075) and gelatin at (2.15).

Support: Cellulose triacetate.

Performance Comparisons

The elements received identical stepped exposures to allow density (D) versus exposure (log E) characteristic curves to be plotted for each of the blue, green and red color records. The exposed elements were processed in the Kodak Flexicolor™ C-41 color negative process described in *British Journal of Photography Annual,* 1988, pp. 196–198.

The dye images were analyzed and compared for speed, reported below in relative log units, where a difference in speed of 0.01 log E equals 1 relative log speed unit. Speed was measured at a toe density Ds, where Ds minus Dmin equals 20 percent of the slope of a line drawn between Ds and a point D' on the characteristic curve offset from Ds by 0.6 log E.

Sharpness differences are reported in CMT (cascaded modulation transfer) units. The equations on which CMT is based are reported in James *The Theory of the Photographic Process,* 4th Ed., Macmillan, New York, 1977, p. 629, with a more qualitative explanation being provided by Keller *Science and Technology of Photography,* VCH, New York, 1993, under the topic Modulation Transfer Function, starting at page 175. Negative CMT differences indicate a loss of sharpness.

Speed and sharpness comparisons are referenced to comparative element 1C in Table I and to comparative element 10C in Table II.

TABLE I

| Element | Layer 3 | Aspect Ratio | Δ Red Speed / Δ Red CMT |
|---|---|---|---|
| 1C | None | Not Appl. | Not Appl. |
| 2C | 4.2 μm ECD X 0.07 μm t (0.431) | 60 | +6 ÷ −0.6 = 10.0 |
| 3E | 4.2 μm ECD X 0.07 μm t (0.648) | 60 | +11 ÷ −0.4 = 27.5 |
| 4E | 4.2 μm ECD X 0.07 μm t (0.862) | 60 | +14 ÷ −0.7 = 20.0 |
| 5C | 4.2 μm ECD X 0.07 μm t (1.29) | 60 | +16 ÷ −2.0 = 8.0 |
| 6E | 2.6 μm ECD X 0.07 μm t (0.648) | 37 | +12 ÷ −0.8 = 15.0 |
| 7C | 1.8 μm ECD X 0.10 μm t (0.648) | 18 | +14 ÷ −1.4 = 10.0 |
| 8E | 3.2 μm ECD X 0.05 μm t (0.862) | 64 | +11 ÷ −0.5 = 22.0 |
| 9C | 1.1 μm ECD X 0.06 μm t (0.862) | 18 | +13 ÷ −1.6 = 8.0 |

From Table I it is apparent that Element 2C increased speed, but the ratio of speed increase to sharpness decrease was below invention capabilities. This is attributed to the low silver coverage in Layer 3. Element 5C showed a larger speed increase, but a lower ratio of speed increase to sharpness decrease than Element 2C and the invention. This is attributed to the high silver coverage in Layer 3. The inferior ratios of speed increase to sharpness decease in Elements 7C and 9C is attributed to lower average aspect ratios than exhibited by Layer 3 emulsions in the Example elements. Elements 3E, 4E, 6E and 8E satisfying invention requirements employed silver coating coverages in Layer 3 and tabular grain average aspect ratios within invention requirements.

TABLE II

| Element | Layer 4 | ΔRed CMT | ΔRed Max. Gamma |
|---|---|---|---|
| 10C | None | Not Appl. | Not Appl. |
| 11E | 4.2 μm ECD X 0.07 μm t (0.862) | −0.8 | +0.09 |
| 12E | 2.6 μm ECD X 0.07 μm t (0.862) | −1.3 | +0.05 |

Both Example Elements 11E and 12E increased speed slightly. However, the principal advantage for locating the red reflective layer below the mid speed red recording emulsion layer was in the increase in maximum gamma.

The invention has been described in detail with particular reference to certain preferred embodiments thereof, but it will be understood that variations and modifications can be effected within the spirit and scope of the invention.

What is claimed is:

1. A color photographic element comprised of a transparent film support and, coated on the support, blue, green and red recording layer units containing couplers that form first, second and third image dyes, respectively, each of the layer units containing radiation-sensitive silver halide grains for forming a developable latent image upon imagewise exposure containing greater than 50 mole percent bromide, based on silver, each of the first, second and third image dyes exhibiting a half-peak absorption bandwidth that occupies at least one 25 nm spectral region not occupied by the remaining of the first, second and third image dyes, and at least the red recording layer unit containing the radiation-sensitive silver halide grains in a plurality of emulsion layers with each emulsion layer located to receive exposing radiation prior to an underlying emulsion layer containing silver halide grains of higher sensitivity than the silver halide grains located in the underlying emulsion layer, wherein, a red light reflective layer free of red absorbing dye and containing tabular silver halide grains having a thickness in the range of from 0.03 to 0.12 μm, an average aspect ratio of greater than 20, and a coating coverage of 0.5 to 1.25 g/m$^2$, and formed of greater than 50 mole percent bromide, based on silver, is located in the red recording layer unit interposed between two emulsion layers.

2. A color photographic element according to claim 1 wherein the tabular silver halide grains in the red light reflective layer underlie a single developable latent image forming emulsion layer in the red recording layer unit.

3. A color photographic element according to claim 1 wherein the tabular silver halide grains in the red light reflective layer have an average aspect ratio greater than 30.

4. A color photographic element according to claim 3 wherein the tabular silver halide grains in the red light reflective layer have an average aspect ratio greater than 40.

5. A color photographic element according to claim 1 wherein the silver halide grains in each of the layers contains greater than 70 mole percent bromide, based on silver.

6. A color photographic element according to claim 4 wherein the silver halide grains in each of the layers contains greater than 90 mole percent bromide, based on silver.

7. A color photographic element according to claim 1 wherein the silver halide grains for forming a developable latent image are silver iodobromide grains.

8. A color photographic element according to claim 1 wherein the silver halide grains in the red light reflective layer are silver bromide grains.

9. A color photographic element according to claim 1 wherein image dye-forming coupler in the blue recording layer unit forms a yellow image dye, image dye-forming coupler in the green recording layer unit forms a magenta image dye, and image dye-forming coupler in the red recording layer unit forms a cyan image dye.

10. A color photographic element according to claim 1 wherein the red light reflective layer is free of image dye-forming coupler.

11. A color photographic element according to claim 1 wherein the tabular silver halide grains in the red light reflective layer have an average thickness in the range of from 0.03 to 0.07 μm.

* * * * *